US006079239A

United States Patent [19]

Hsiao

[11] Patent Number: 6,079,239

[45] Date of Patent: Jun. 27, 2000

[54] TAMPERPROOF LOCK

[76] Inventor: Mei-Chun Hsiao, 9 Lane 18, Section 2, Shan Jiao Road, Yuan Lin Township, Changhua, Taiwan

[21] Appl. No.: 09/281,437

[22] Filed: Mar. 30, 1999

[51] Int. Cl.[7] ..... E05B 29/04

[52] U.S. Cl. ..... 70/358; 70/387; 70/419; 70/492

[58] Field of Search ..... 70/387, 419, 358, 70/401, 492

[56] References Cited

U.S. PATENT DOCUMENTS

| | | | |
|---|---|---|---|
| 596,237 | 12/1897 | Damon | 70/387 |
| 1,406,567 | 2/1922 | Lochina | 70/419 |
| 2,439,099 | 4/1948 | Ressetar | 70/419 |
| 2,552,012 | 5/1951 | O'Kane | 70/419 |
| 2,682,764 | 7/1954 | Kotab | 70/419 |
| 4,061,004 | 12/1977 | Pappanikolaon | 70/491 |
| 4,104,898 | 8/1978 | Fois | 70/419 |
| 5,163,310 | 11/1992 | Wang | 70/491 |

*Primary Examiner*—Lloyd A. Gall
*Attorney, Agent, or Firm*—Rabin & Champagne, P.C.

[57] ABSTRACT

A tamperproof lock includes a housing of a cylindrical construction, and a lock body located in the cylindrical housing. The lock body is rotatably located in the housing such that the lock body can be turned by a key which is inserted thereinto. As the lock body is turned a predetermined angle by the key, the lock body is disengaged with the housing.

6 Claims, 5 Drawing Sheets

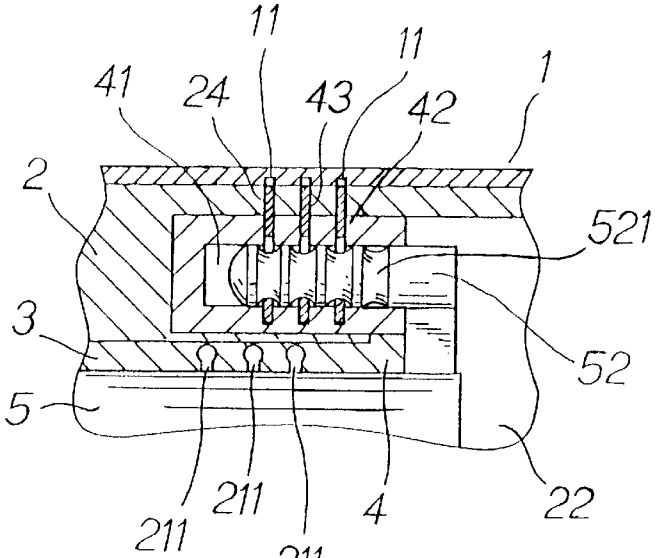
FIG.8-B
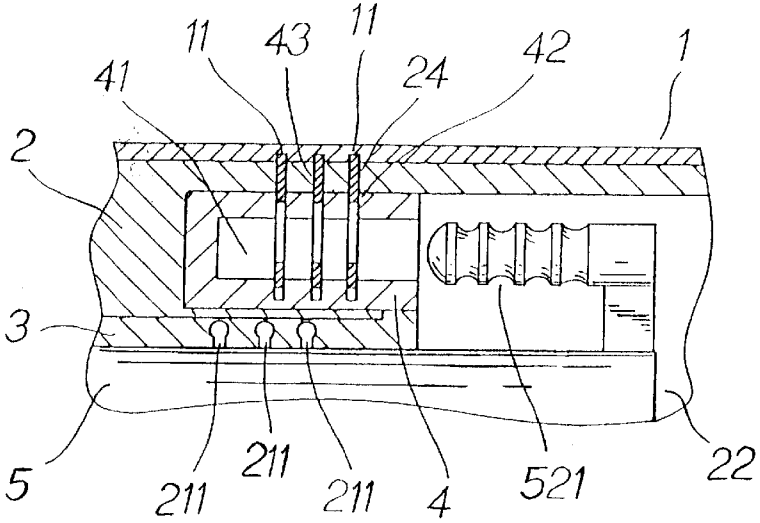
FIG.8-A
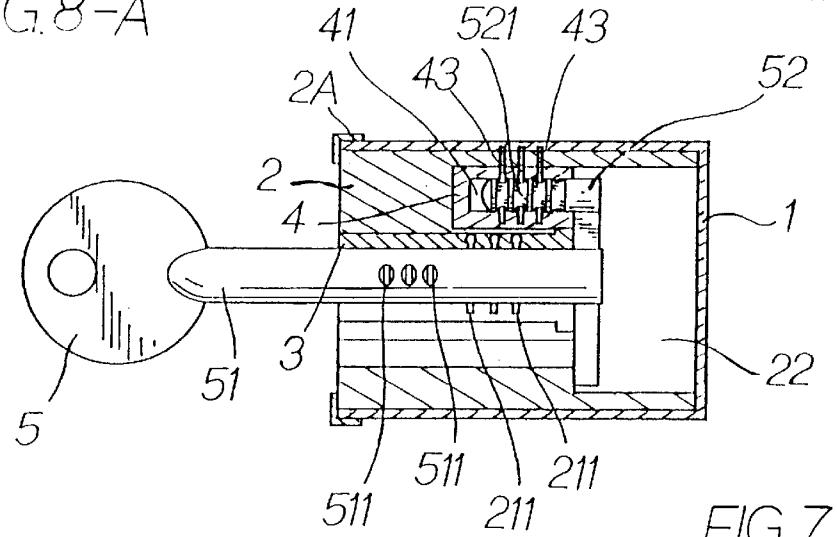
FIG.7

TAMPERPROOF LOCK

FIELD OF THE INVENTION

The present invention relates generally to a lock, and more particularly to a tamperproof lock.

BACKGROUND OF THE INVENTION

The most commonly-used household locks include the combination lock and the padlock. The combination lock is operated by a dial that is turned to a set series of numbers or letters to work the mechanism that opens it. The combination lock has an advantage in that it is operated without the use of a key; nevertheless it has a disadvantage that calls for the user of the lock to memorize the set series of numbers or letters. In the event that the user of the combination lock forgets the set series of numbers or letters, the combination lock can not be operated. As a result, the combination lock must be destroyed by the authorized person to allow the owner of the combination lock to gain an access to the property. The padlock is operated by means of a key. The padlock can be easily tampered with by an unauthorized person by means of a pointed tool.

SUMMARY OF THE INVENTION

The primary objective of the present invention is therefore to provide an improved lock which is free from the deficiencies of the conventional locks described above. The improved lock of the present invention is relatively tamperproof In keeping with the principle of the present invention, the foregoing objective of the present invention is attained by a tamperproof lock comprising a housing of a cylindrical construction, and a lock body located in the cylindrical housing. The lock body is rotatably located in the housing such that the lock body can be turned by a key which is inserted there into. As the lock body is turned a predetermined angle by the key, the lock body is disengaged with the housing.

The foregoing objective, features and functions of the present invention will be more readily understood upon a thoughtful deliberation of the following detailed description of the present invention with reference to the accompanying drawings.

BRIEF DESCRIPTION OF THE DRAWINGS

FIG. 7 shows a schematic view of the key which is reinserted into the second lock core of the present invention.

FIG. 8A is a partial enlarged view of the key before it has been reinserted into the second lock core of the present invention.

FIG. 8B is a partial enlarged view of the key after it has been reinserted into the second lock core of the present invention.

DETAILED DESCRIPTION OF THE INVENTION

Figures 1, 3:
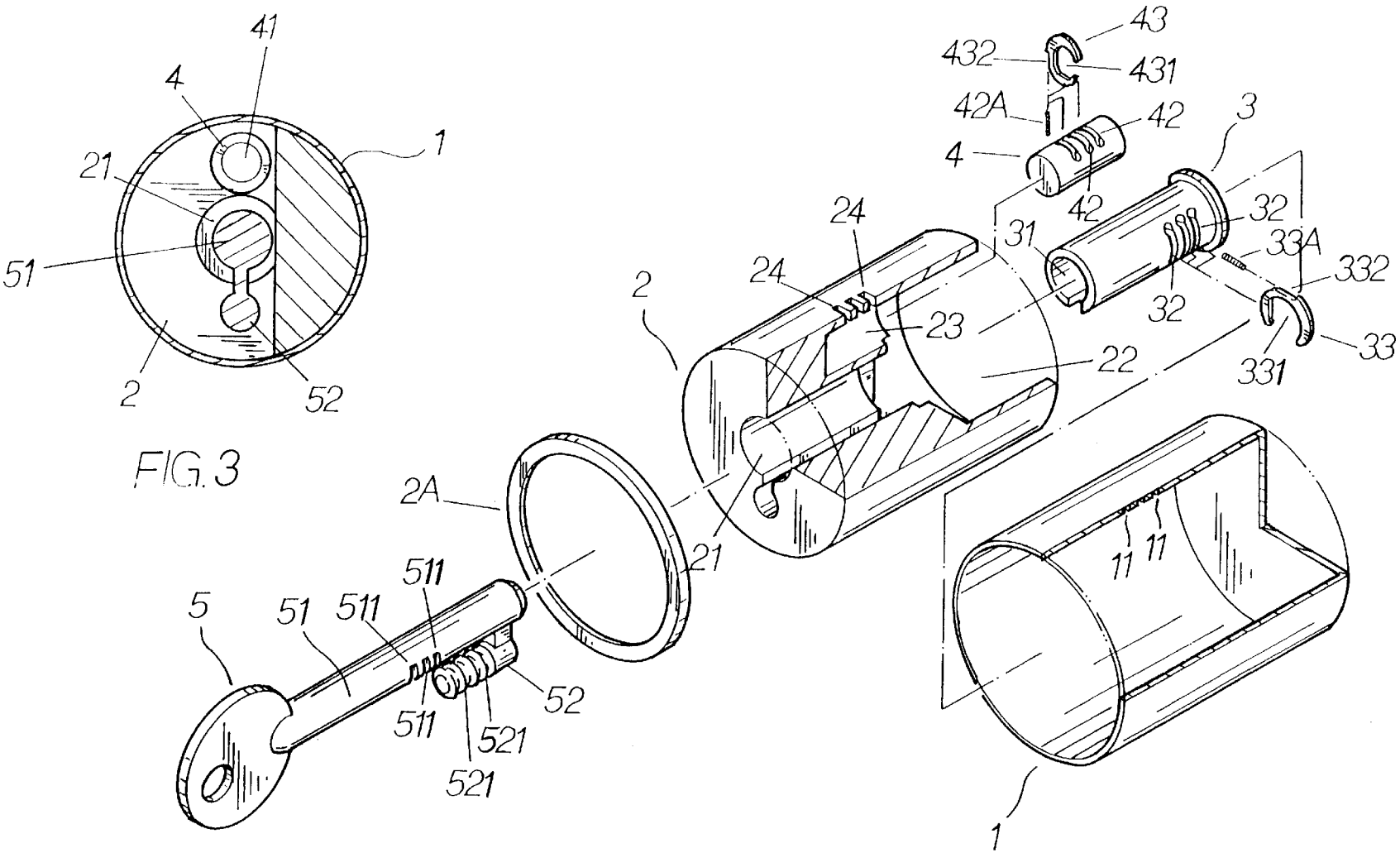
FIG. 1 shows an exploded view of the present invention.
FIG. 3 shows a schematic view of positions of a first lock core and a second lock core of the lock body of the present invention.
Figure 2:
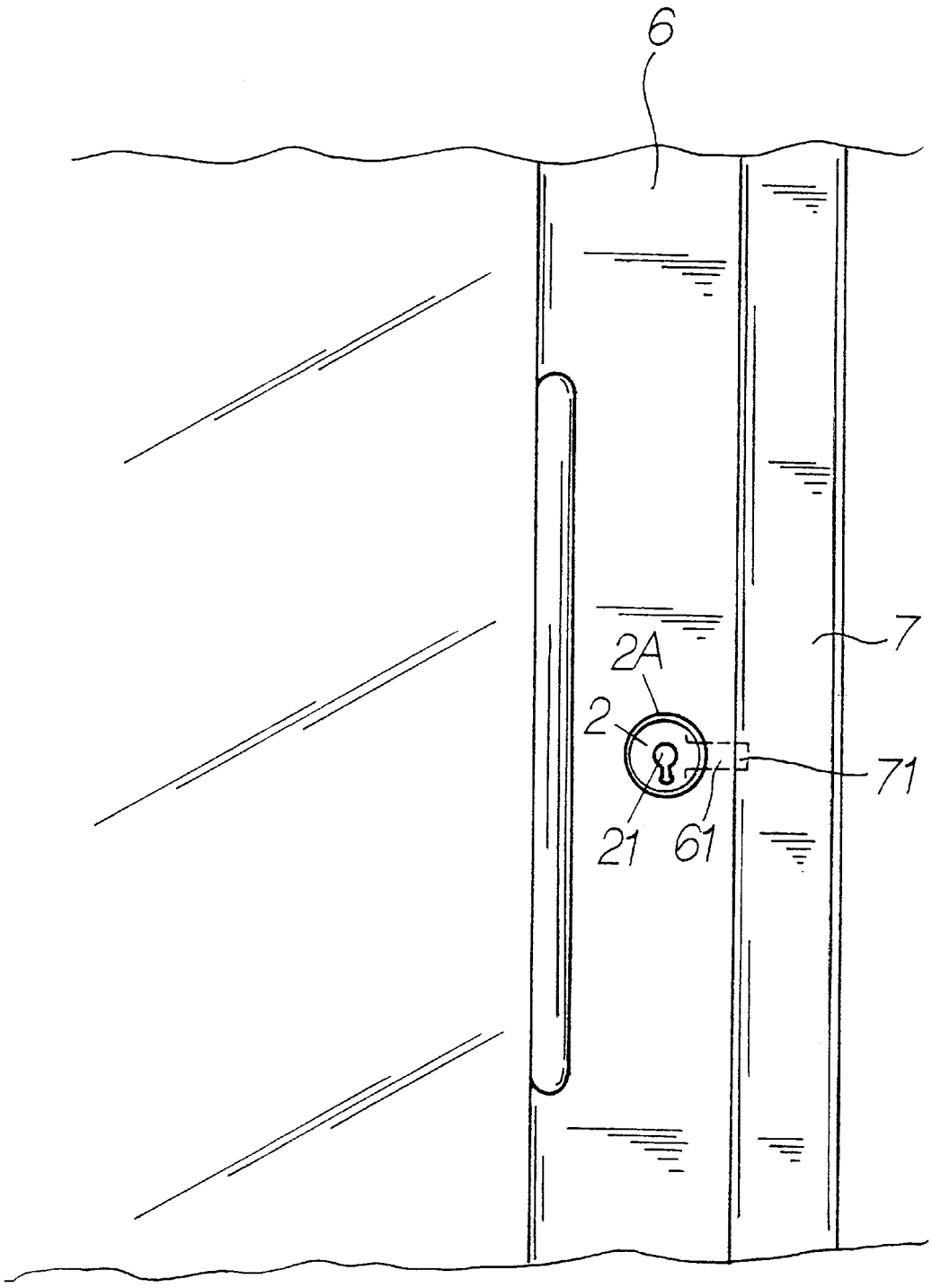
FIG. 2 shows a schematic view of the present invention in conjunction with a door.

As shown in all drawings provided herewith, a lock embodied in the present invention is fastened with a hole 71 of the door frame 7 of a door 6. The lock of the present invention is composed of a housing 1 of a cylindrical construction, and a lock body 2 located rotatably in the housing 1.

The housing 1 is securely fastened with the door 6 in conjunction with a lock tongue 61 and is provided with a plurality of locating slots 11.

The lock body 2 is rotatably mounted in the housing 1 and is provided with a key hole 21 into which a key 5 is inserted to operate the lock. The lock body 2 is provided with a plurality of locating holes 24 for locating a plurality of lock pieces 43 of a second lock core 4. The key hole 21 is provided with a plurality of retaining slots 211 for retaining a lock piece 33 of a first lock core 3, and in the innermost bottom thereof with a swivel slot 22. Located between the key hole 21 and the swivel slot 22 is a round slot 23 for disposing the second lock core 4. After the lock body 2 is located in the housing 1, the lock body 2 is shielded by a cover 2A. The first lock core 3 has a lock core hole 31 and a plurality of receiving slots 32 for disposing the lock piece 33 and the spring 33A. The lock piece 33 has a hollow interior 331 and a recessed portion 332 for disposing the spring 33A. The second lock core 4 is located in the round slot 23 of the lock body 2 and is provided with slots 42 for disposing the lock piece 43 and the spring 42A. The lock piece 43 is oval in shape and is provided with a hollow interior 431 and a recessed portion 432 for disposing a spring 42A. The key 5 has a shank 51 which is provided at the front end thereof with a key portion 52, and with a plurality of grooves 511 corresponding to the retaining slots 211 of the lock body 2. The key portion 52 is provided with a plurality of grooves 521.

Figure 4:
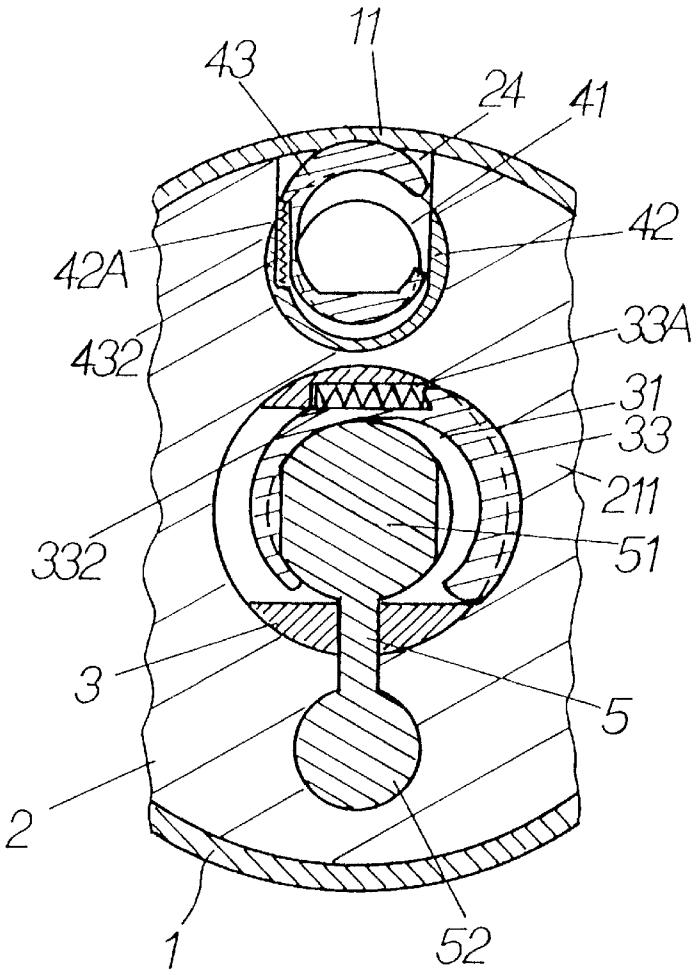
FIG. 4 shows a schematic view of the first lock core and a key inserted into the first lock core of the present invention.
Figure 5:
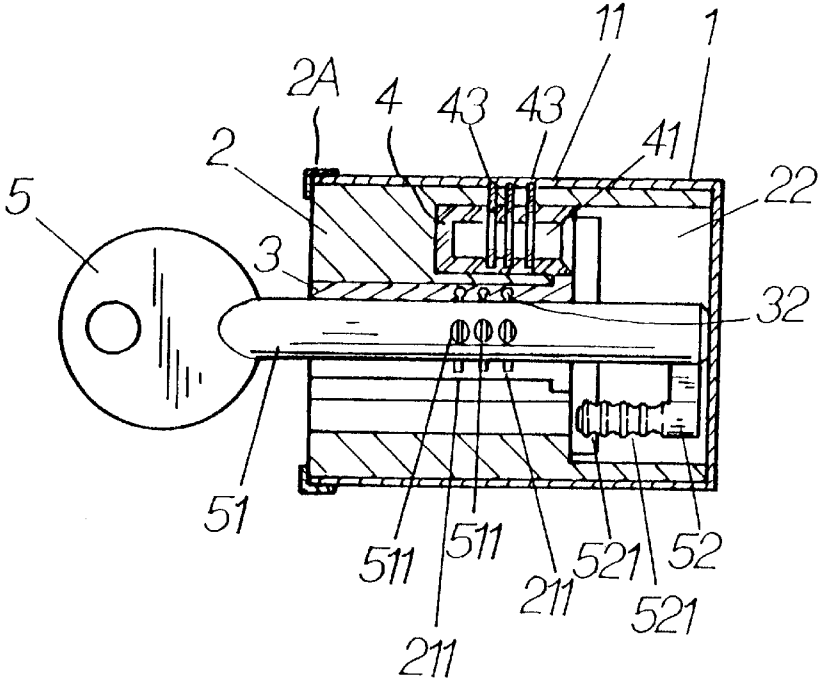
FIG. 5 shows a schematic view of the lock body of the present invention and the key which is inserted into the bottom of the lock body.
Figure 6:
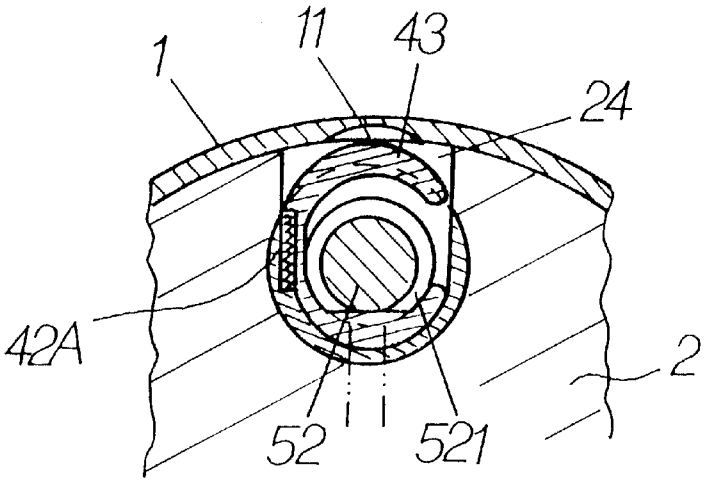
FIG. 6 shows a schematic view of the key of the present invention which is turned to the second lock core.
Figure 9:
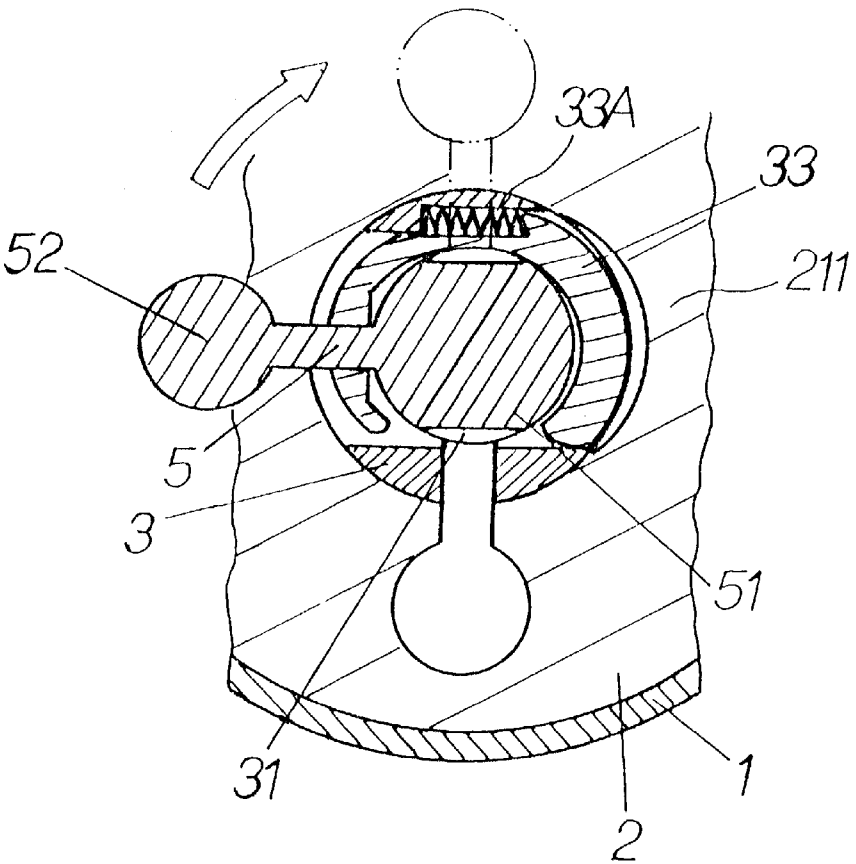
FIG. 9 shows a direction of rotation of the key for insertion into the second lock core.

As shown in FIG. 3, when the key 5 is inserted into the key hole 21 of the lock body 2, the shank 51 of the key 5 comes in contact with the lock piece 33 via the lock core hole 31 of the first lock core 3 such that the spring 33A is compressed by the shank 51 of the key 5. As a result, the lock piece 33 which was engaged with the retaining slots 211 as shown in FIG. 4, moves away from the retaining slots 211 of the key hole 21. Thereafter, the shank 51 of the key 5 is further inserted into the swivel slot 22 such that the grooves 511 of the shank 51 are in contact with the lock piece 33, which is pushed by the spring 33A to be retained in the grooves 511. As a result, the key 5 and the first lock core 3 are joined together as a united body, as shown in FIG. 5. The key 5 is then turned an angle ranging between 1–360 degrees such that the key portion 52 is aligned with the lock core hole 41 of the second lock core 4, as shown in FIG. 6, FIG. 8A and FIG. 9 The key 5 is subsequently pulled back in reverse such that the key portion 52 is inserted into the lock core hole 41 of the second lock core 4, and that the key portion 52 comes in contact with the eccentric lock piece 43, and further that the spring 42A is compressed so that the lock piece is disposed in the locating hole 24 and the grooves 521 of the key portion 52, as shown in FIG. 6 and FIG. 7. This cause the lock piece 43 to be released from locating slots 11, as shown in FIG. 8B. The entire lock body 2 can be then acted on by the key 5 so that the lock body 2 is entirely disengaged with the housing 1. The lock body 2 can be once again engaged with the housing 1 by turning the lock body 2 back to its original position before the key 5 is pushed forward to cause the key portion 52 to disengage the second lock core 4. The key 5 is turned back to its initial angle before the key 5 is pulled out of the first lock core 3. As the result, the lock of the present invention is in the locking state.

The embodiment of the present invention described above is to be deemed in all respects as being merely illustrative and not restrictive. Accordingly, the present invention may be embodied in other specific forms without deviating from the spirit thereof The present invention is therefore to be limited only by the scope of the following appended claim.

What is claimed is:

1. A tamperproof lock, comprising:

a cylindrical lock body, said lock body having a key hole accessible from a front end of said lock body, a swivel slot in a rear portion thereof and in communication with the key hole, and having a round slot disposed adjacent to the key hole, the round slot being in communication with the swivel slot, said lock body further having at least one locating hole disposed in a side thereof and in communication with the round slot;

a first lock core disposed within the key hole, and being releasably engagable with said lock body;

a second lock core disposed within the round slot, and having at least one lock piece that is disposed in registration with the at least one locating hole;

a housing covering said lock body, and having at least one locating slot formed in a side thereof and in registration with the at least one locating hole, said lock piece being positionable to project through the locating hole and into the locating slot to fix said lock body relative to said housing, and being movable to a further position in which said lock piece is moved out of engagement with the locating slot so that said lock body is free to rotate relative to said housing; and a key, whereby when the key is inserted into the key hole from the front end of said lock body and in a first direction, the key releases said first lock core from said lock body, so that when the key is rotated, said key and said first lock core rotate together as a unit, and whereby after said key is rotated, said key is movable in a second direction opposite to the first direction, so that said key engages with said second lock core to move said lock piece to the further position in which said lock piece is moved out of engagement with the locating slot so that said lock body is free to rotate relative to said housing.

2. The lock recited in claim 1, wherein said second lock core has an opening therein for accommodating said key, and has a slot formed in a side thereof, said lock piece having an opening therein, and being positioned within the slot of said second lock core so that the opening of said lock piece is disposed within the opening in said second lock core, whereby when said key is inserted into said second lock core, said key is additionally inserted through the opening in said lock piece, so that said key urges said lock piece out of engagement with the locating slot.

3. The lock recited in claim 2, wherein said lock piece has a flat, oval configuration.

4. The lock recited in claim 3, wherein said second lock core further includes a spring in contact with said lock piece and urging said lock piece into engagement with the locating slot.

5. The lock recited in claim 4, wherein said key has a shank, and a key portion connected to an end of said shank and arranged to extend parallel to said shank, said key portion engaging with said lock piece when said key is inserted through the opening in said lock piece, so that said key portion moves said lock piece against the urging of said spring.

6. The lock recited in claim 1, wherein said first lock core has an opening extending therethrough for accommodating said key, and has a slot formed in a side thereof, said first lock core further having a lock piece having an opening therein, and being positioned within the slot of said first lock core so that the opening of said lock piece of said first lock core is disposed within the opening in said first lock core, and wherein the lock body has at least one retaining slot in a region of the key hole, the retaining slot accommodating the lock piece of said first lock core when said key is removed from said first lock core, and wherein when said key is inserted through the opening in said lock piece of said first lock core, said key urges said lock piece out of engagement with the retaining slot to allow said key and said first lock core to rotate as a unit.

* * * * *